US007837049B2

(12) United States Patent
Boukobza

(10) Patent No.: US 7,837,049 B2
(45) Date of Patent: Nov. 23, 2010

(54) CONTAINER, IN PARTICULAR A BOTTLE, MADE OF THERMOPLASTIC MATERIAL

(75) Inventor: Michel Boukobza, Octeville-sur-Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 118 days.

(21) Appl. No.: 11/995,168

(22) PCT Filed: Jun. 26, 2006

(86) PCT No.: PCT/FR2006/001481

§ 371 (c)(1),
(2), (4) Date: Jan. 9, 2008

(87) PCT Pub. No.: WO2007/006880

PCT Pub. Date: Jan. 18, 2007

(65) Prior Publication Data

US 2008/0197105 A1 Aug. 21, 2008

(30) Foreign Application Priority Data

Jul. 12, 2005 (FR) ..... 05 07493

(51) Int. Cl.
*B65D 1/02* (2006.01)

(52) U.S. Cl. ..... 215/381; 215/382; 215/383; 220/672; 220/671

(58) Field of Classification Search ..... 215/381, 215/379, 383, 382
See application file for complete search history.

(56) References Cited

U.S. PATENT DOCUMENTS

| | | | | |
|---|---|---|---|---|
| 4,818,575 | A * | 4/1989 | Hirata et al. | 428/36.7 |
| 5,067,622 | A * | 11/1991 | Garver et al. | 215/381 |
| 5,632,397 | A * | 5/1997 | Fandeux et al. | 215/382 |
| 5,908,128 | A | 6/1999 | Krishnakumar et al. | |
| 6,230,912 | B1 * | 5/2001 | Rashid | 215/383 |
| 6,598,755 | B1 * | 7/2003 | Pedulla et al. | 215/382 |
| 7,077,279 | B2 * | 7/2006 | Melrose | 215/381 |

(Continued)

FOREIGN PATENT DOCUMENTS

FR 2 275 375 A1 1/1976

*Primary Examiner*—Anthony Stashick
*Assistant Examiner*—Cynthia F Collado
(74) *Attorney, Agent, or Firm*—Sughrue Mion, PLLC

(57) ABSTRACT

A thermoplastic container (1) having a body (2) provided with at least one groove (6) that forms a closed loop and that extends perpendicularly to the axis of the body; the groove having a depth (p) that lies in the range 3 mm to 6 mm; in right section, the groove comprises: an bottom (8) that is rounded, having a small radius of curvature (R1) in the range 0.2 mm to 1.5 mm; two faces (9) that are plane and that flare apart from each other on either side of the bottom (8) at an angle ($\alpha$) in the range 50° to 90°; and two faces (10) that are curvilinear, and that extend away from the respective plane faces (9) at an angle ($\beta$) that is less than 180°, and that are connected thereto by respective rounded walls (11) of small radius of curvature (R2) that does not exceed 1.5 mm, and that are connected tangentially to the wall (12) of the body (2). Such a groove (6) is deformable with a capacity to pinch axially in the presence of an axial force applied to the container.

15 Claims, 2 Drawing Sheets

U.S. PATENT DOCUMENTS 7,108,151 B2 * 9/2006 Higuchi ..... 220/666
7,296,701 B2 * 11/2007 Ozawa et al. ..... 215/381
7,513,378 B2 * 4/2009 Mori et al. ..... 215/381
2004/0200799 A1 10/2004 Yourist et al.

* cited by examiner

CONTAINER, IN PARTICULAR A BOTTLE, MADE OF THERMOPLASTIC MATERIAL

FIELD OF THE INVENTION

The present invention relates in general to the field of containers, in particular bottles, made of thermoplastic material such as PET, and it relates more specifically to improvements to those containers that include a body provided with at least one peripheral, closed-loop designed groove.

BACKGROUND OF THE INVENTION

When full, containers of the specified type present significant rigidity that then prevents them from withstanding even relatively limited external or internal forces without damage.

Thus, an external force applied axially on the neck of a container of that type (e.g. when too many containers are stacked one on top of the other—typically packs of bottles stacked on pallets—) can cause the wall made of plastics material to kink at the shoulder of the container, below the neck; as a result the neck enters, in part, into the shoulder, generally on one side of the container, such that the neck thus slopes significantly relative to the axis of the container. Often, the wall does not rupture and liquid therefore does not leak out, and the content of the container can be used. However, customers always reject containers damaged in this way, which thus become unsellable.

In addition and above all, when a container of the type under consideration is filled with a hot liquid and is then closed, air that remains trapped in the container decreases slightly in volume on cooling down. This typically occurs with containers that are filled in high-speed filling installations, in which the containers are closed well before the liquid that was poured in hot has cooled down to ambient temperature. The shrinkage in the volume of the air during cooling thus places the inside volume of the container in a state of reduced pressure.

For the container to be able to withstand this reduced pressure without deforming, it needs to present sufficient mechanical rigidity, which means that it has thick walls for example; in other words, such a container requires more raw material and is therefore more costly, which is not acceptable to producers of packaged liquids. It is indeed known to manufacture containers having a body that is specially configured (a paneled body) so as to be able to support such reduced pressure without visibly deforming. However, such specially-shaped containers are also significantly more costly than conventional containers.

However, if the container is not strong enough, it deforms in uncontrolled manner, and, once again, its unattractive appearance makes it difficult to sell.

There thus exists an urgent need for containers of conventional shape, typically for bottles having a substantially cylindrical general shape, but that are suitable for withstanding forces, at least to some extent, without substantially deforming in uncontrolled manner, in particular when being filled with a hot liquid, and without notably adding to the cost of the container.

SUMMARY OF THE INVENTION

The invention seeks precisely to satisfy those expectations and it proposes an improved container that can withstand forces, whether they are external forces applied in particular to the neck, for example, or above all internal forces as a result of the container being put under reduced pressure, in particular after being filled with a hot liquid.

To these ends, the invention proposes a container, in particular a bottle, made of thermoplastic material such as PET, and including a body provided with at least one peripheral closed-loop designed groove and that extends in a plane that is substantially perpendicular to the axis of the body, which container, being arranged in accordance with the invention, is characterized in that the groove has a depth that lies in the range about 3 millimeters (mm) to 6 mm, and in that, in transverse section, the groove comprises:

- a bottom that is substantially rounded, having a relatively small radius of curvature that lies in the range 0.2 mm to 1.5 mm;
- two faces that are substantially plane and that flare apart from each other on either side of said bottom, forming between them an angle that lies in the range about 50° to 90°; and
- two faces that are curvilinear, in particular circularly arcuate, and that, at one end, extend away from the respective plane faces at an angle that is substantially less than 180°, and that are connected thereto by respective rounded walls of relatively small radius of curvature that does not exceed 1.5 mm, and that, at the other end, are connected substantially tangentially to the wall of the body.

By means of this arrangement, the groove is a groove that can deform axially in resilient manner and that possesses a capacity to pinch axially in the presence of an axial force applied to the container, in particular under the effect of a shrinkage in volume during cooling of a liquid that has been poured into the container while hot, and/or under the action of a force applied approximately axially on the container (e.g. as with stacked containers). Because of the groove possessing a uniform shape over the entire periphery of the container body, it pinches in identical manner over its entire extent, such that the container body deforms while remaining coaxial about its axis and without its external generator lines curving. In other words, the overall shape of the container remains identical, without curving, and its deformation (axial compacting) is almost unnoticeable, such that the commercial losses that used to be caused by containers deforming are now avoided. A container arranged in this way thus satisfies practical expectations.

Preferably, the depth of the deformable groove is about 4 mm.

Also preferably, the bottom of the deformable groove has a radius of curvature of about 0.5 mm Advantageously, the plane faces of the deformable groove form between them an angle that lies in the range about 60° to 80°, and that is preferably about 70°.

Also advantageously, the rounded wall between the plane faces and the substantially curvilinear faces possesses a radius of curvature that lies in the range about 0.8 mm to 1.2 mm, and that is preferably about 1 mm.

Implementing the dispositions of the invention may give rise to various configurations for the container body.

In particular, in one possible embodiment, the container may include a plurality of deformable grooves that are spaced apart axially from one another, the number of grooves being determined as a function of the expected degree of axial deformation, which, in the most particularly envisaged circumstance of being filled with a hot liquid, depends on the temperature of the filling liquid and/or on the dimensions of the body of the container, in particular on its transverse dimensions. By way of example, it is possible to provide two or three grooves when filling with a liquid at a temperature that is not very high (e.g. about 80° C.), whereas three to five grooves could be provided when filling with a liquid at a temperature that is very high (e.g. about 90° C.).

It is also possible to ensure that at least some of the deformable grooves are disposed one after another, or, by way of variant, to ensure that at least one non-deformable groove is interposed between at least some of the deformable grooves; in particular, in this event, it is possible to provide deformable grooves that alternate with non-deformable grooves. It is also possible to envisage that the container body is provided with a small number of deformable grooves at any location (bottom, top, middle), the remainder of the body remaining exempt of any groove (e.g. for the purposes of marking or of affixing a label).

An application to which the dispositions of the invention apply most particularly, but not exclusively, relates to a container of the bottle type that is arranged as indicated above and that possesses a body of substantially cylindrical section.

Of course, it is possible to apply the invention to any type of container, regardless of the shape of its section. Thus, it becomes possible to strengthen a container of polygonal section, e.g. of triangular section; it also becomes possible to strengthen containers of square or rectangular section, or even of square or rectangular section with rounded corners.

By means of the above-recited dispositions, a container made in accordance with the invention possesses a considerable capacity to deform axially without significantly affecting its general shape. By way of concrete example, it is typically possible to make a 0.5 liter (l) bottle that, after being filled with a liquid at a temperature that is high (e.g. at 90° C. to 92° C.), is suitable for presenting a reduction in volume of about 15 milliliters (ml), which gives rise to a reduction in height of about 4 mm, or a compacting of the body of about 3.15%.

Moreover, and by way of an advantage that is far from negligible, containers made in accordance with the invention, while presenting the above-described improved characteristics, can also be substantially lighter than prior-art containers. Thus, typically, a prior-art container of capacity of 0.5 l, having a paneled body, and having a weight of 28 grams (g) to 29 g, can be replaced by a container of the same capacity, but having a weight of about 26 g, or even by a container that is even lighter, having a weight of about 22 g to 23 g.

BRIEF DESCRIPTION OF THE DRAWINGS

The invention will be better understood on reading the following detailed description of some preferred embodiments, given by way of non-limiting example only. In the description, reference is made to the accompanying drawings, in which.

DETAILED DESCRIPTION OF THE INVENTION

Figure 1:
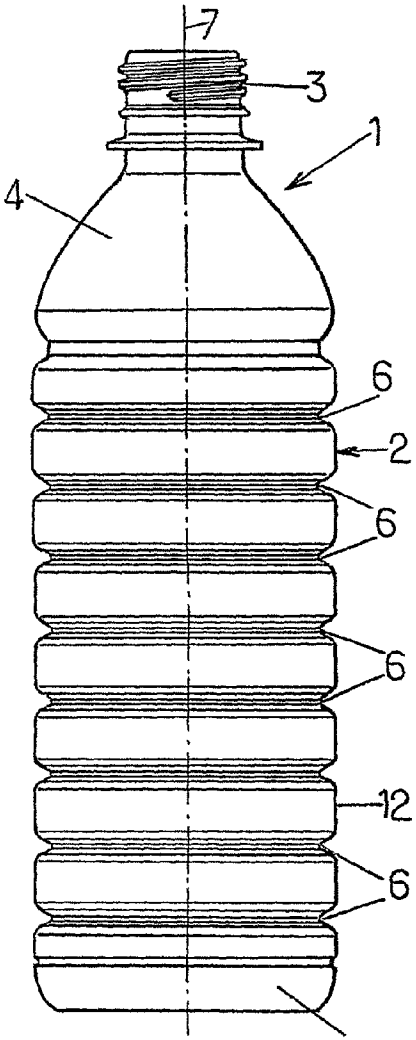

With reference initially to FIG. 1, there is shown, in side view, a container 1, in the form of a bottle, made of thermoplastic material, such as PET. The container 1 comprises a body 2, shown as being substantially cylindrical in general shape, that is connected at its top end to a neck 3 via a rounded portion or shoulder 4, and that is connected internally to a container bottom. The body 2 is provided with at least one peripheral closed-loop designed groove 6 and that extends in a plane that is substantially perpendicular to the axis 7 of the body 2.

Figure 4:
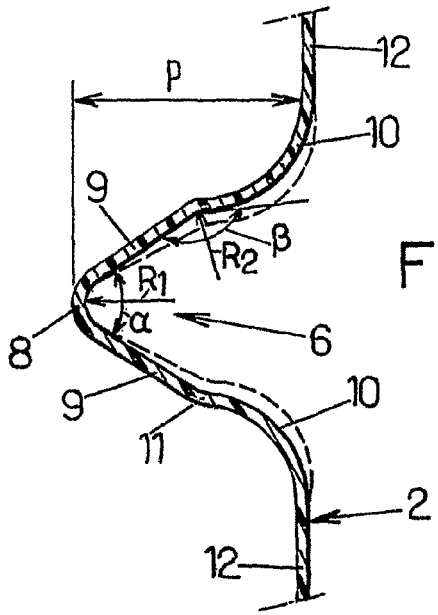
FIG. 4 is a diagrammatic view of the right section of a groove in accordance with the invention, provided on the containers in FIGS. 1 to 3.

In FIG. 4, the groove 6 is shown in much larger scale. The groove 6 possesses a depth p that lies in the range about 3 mm to 6 mm. In a transverse section, the groove 6 comprises:

- a bottom 8 that is substantially rounded, having a relatively small radius of curvature R1 that lies in the range 0.2 mm to 1.5 mm;
- two faces 9 that are substantially plane and that flare apart from each other on either side of said bottom 8, forming between them an angle $\alpha$ that lies in the range about 50° to 90°, and advantageously in the range 60° to 80°; and
- two faces 10 that are curvilinear, and that, at one end, extend away from the respective plane faces 9 at an angle $\beta$ that is substantially less than 180°, and that are connected to said plane faces 9 by respective rounded walls 11 of relatively small radius of curvature R2 that does not exceed 1.5 mm, advantageously lying in the range 0.8 mm to 1.2 mm, and that, at the other end, are connected substantially tangentially to the wall 12 of the body 2.

The bottom 8 of the groove 6 arranged in this way constitutes a hinge via which the two plane faces 9 can pivot relative to each other, together forming a pincer having an opening that varies as a function of the load applied to one and/or the other of its plane faces 9. The rounded walls 11 of small radius of curvature form hinges via which the curvilinear faces 10 can accompany the displacements of the plane faces 9. A groove arranged in such a manner presents a large capacity for controlled deformation. In FIG. 4, dashed lines show the outline of the deformed groove 6.

In a typical embodiment relating to a bottle made of PET and having a capacity of 0.5 l, the groove 6 has a depth of about 4 mm, its bottom 8 has a radius of curvature R1 of about 0.5 mm, its two substantially plane faces 9 form between them an angle $\alpha$ of about 70°, the two curvilinear faces 10 form an arc of a circle, and the rounded wall 11 has a radius of curvature R2 of about 1 mm.

The groove in accordance with the invention can give rise to numerous variant embodiments as a function of the amount of deformation desired for the container. A few of the possible variants are shown by way of example in FIGS. 1 to 3.

A groove in accordance with the invention can indeed be implemented on its own in a container in which only a small amount of axial deformation is desired.

However, in practice, and in particular for containers for being filled with a hot liquid (typically at 80° C. to 90° C., or even more), it is desirable for the container to be able to withstand a restriction in volume of the order of a few tens of milliliters (e.g. about 10 ml to 20 ml for a 0.5 l bottle, or a variation in height of about 4 mm). It is thus necessary to provide a plurality of deformable grooves arranged in accordance with the invention, the deformable grooves possibly being combined with standard grooves that are not substantially deformable.

Figure 2:
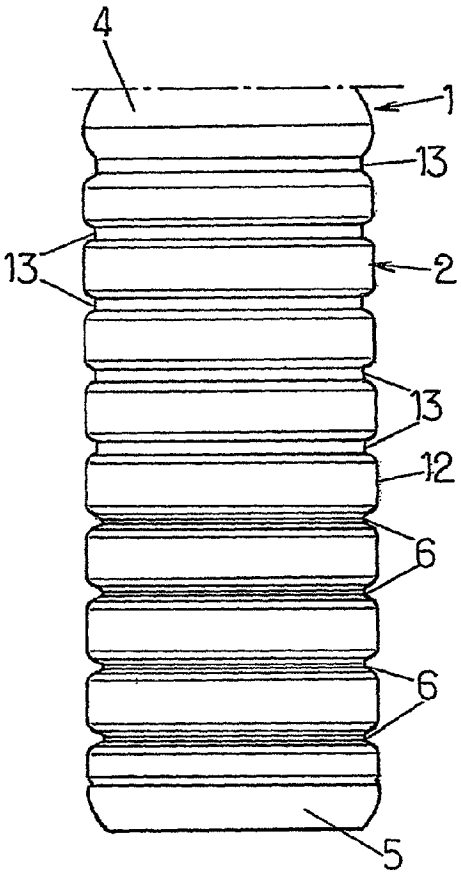

In FIG. 1, the container 1 in the form of a bottle is provided exclusively with deformable grooves 6 arranged as described above, i.e. eight deformable grooves 6 distributed over approximately the entire height of the body 2 of a 0.5 l bottle in this concrete example. Specifically, two consecutive grooves of the container are separated by a distance of about 12.7 mm, and, for the two bottom grooves, the displacement of one groove relative to the other supposedly-stationary groove was measured to be about 0.4 mm, i.e. a displacement of about 3.15%. In FIG. 2, the deformable grooves 6 are grouped together in the bottom part of the body 2 of the container 1 in the form of a bottle, while the top portion of the container is arranged in any desired manner; in the embodiment shown, the top portion of the body 2 is provided with standard grooves 13 that are substantially non-deformable.

Figure 3:
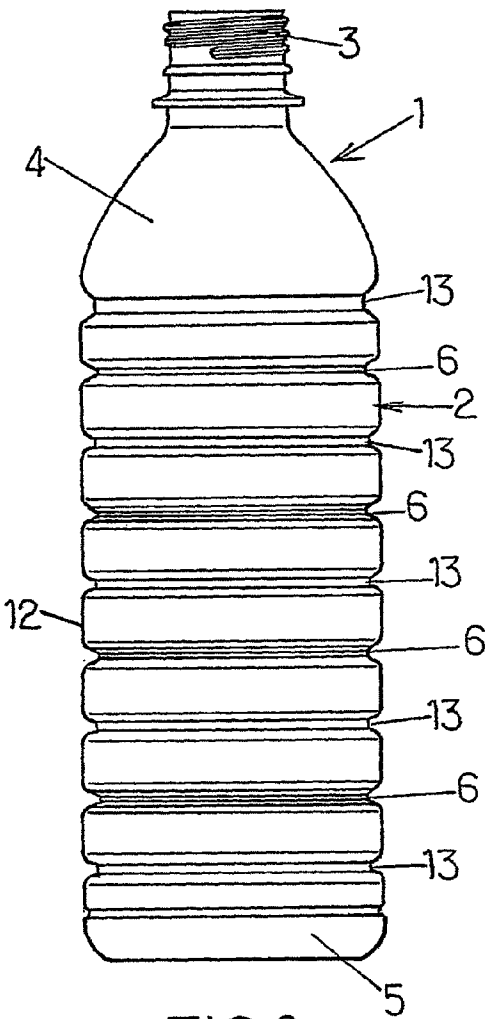
FIGS. 1 to 3 are side views respectively of three containers of the bottle type, provided with at least one groove in accordance with the invention.

In FIG. 3, the body 2 of the container 1, in the form of a bottle, is, over substantially its entire height, provided with alternating grooves 6 of the invention and standard grooves 13 that are substantially non-deformable. By way of variant, it is possible to provide pairs of grooves of each type in alternation.

Figure 5A:
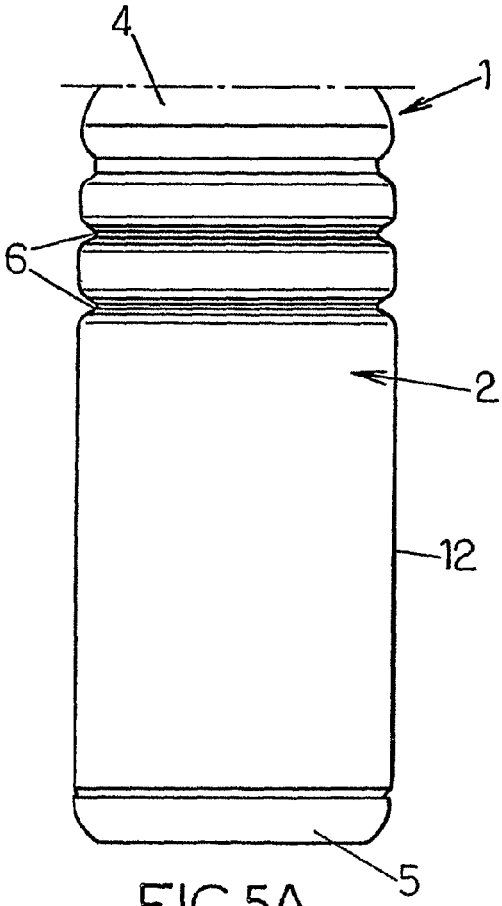
FIGS. 5A to 5B are side views respectively of two other containers of the bottle type, provided with at least one groove in accordance with the invention.
Figure 5B:
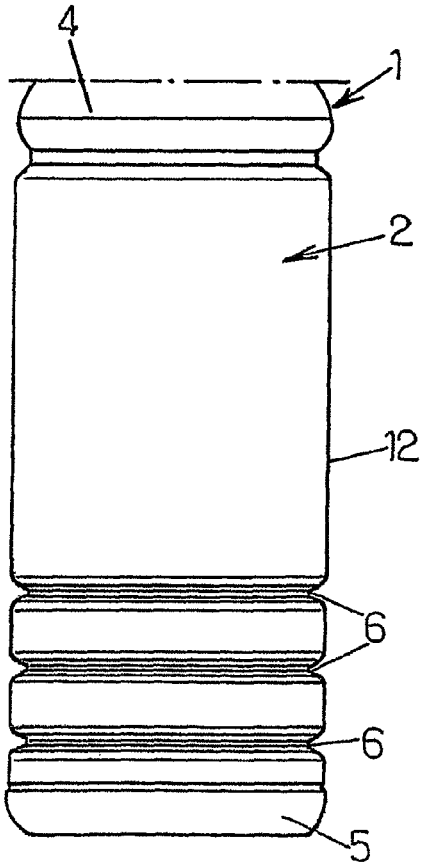

It should be emphasized that, regardless of the distribution of the deformable grooves, the presence of standard non-deformable grooves in the remainder of the body of the container is not essential; furthermore, when they are localized, the deformable grooves can be disposed at any desired location (bottom, top, middle) of the container body, the remainder of the body possibly being formed in any appropriate way (e.g. smooth, polygonal, . . . ), in particular for the purposes of marking or of affixing a label. By way of example, in FIG. 5A, the body 2 of a container, in the form of a bottle, is provided with two deformable grooves 6 of the invention that are situated one after the other in the top portion of the body, the remainder of the body being smooth, not having any grooves. In FIG. 5B, the body 2 of a container, in the form of a bottle, is provided with three deformable grooves 6 of the invention that are situated one after the other in the bottom portion of the body, the remainder of the body being smooth, not having any grooves.

Regardless of the configuration chosen for the distribution of the deformable grooves 6, their number is selected as a function of the amplitude of the axial deformation desired for the container. In particular, the amplitude is a function of the temperature of the hot filling liquid and/or of the dimensions of the body of the container, in particular of its transverse dimensions. Thus, for a liquid at a temperature that is not very high, e.g. about 80° C., the number of deformable grooves 6 can be two or three; however, when the liquid is at a temperature that is relatively high, e.g. about 90° C. to 92° C., the number of deformable grooves 6 should be higher, about three to five.

The invention claimed is:

1. A container, in particular a bottle, made of thermoplastic material such as PET, and including a body having a wall and provided with at least one peripheral closed-loop designed groove that extends in a plane that is substantially perpendicular to the axis of the body, wherein the groove possesses a depth (p) that lies in the range about 3 mm to 6 mm, and wherein, in a transverse section, the groove comprises:

a bottom that is substantially rounded, having a relatively small radius of curvature that lies in the range 0.2 mm to 1.5 mm;

two faces that are substantially plane and that flare apart from each other on either side of said bottom, forming between them an angle that lies in the range about 50° to 90°; and two faces that are curvilinear, and connected at one end to a respective plane face, and which extend away from their respective plane face in a direction different from the direction of the plane face, such that an angle formed at the connection between the plane face and the curvilinear face is substantially less than 180°, and wherein the plane face and curvilinear face are connected thereto by respective rounded walls of relatively small radius of curvature that does not exceed 1.5 mm, and wherein the other end of each curvilinear face is connected substantially tangentially to the wall of the body;

whereby the groove is an axially deformable groove that possesses a capacity to pinch axially in the presence of an axial force applied to the container.

2. A container according to claim 1, wherein the depth of the deformable groove is about 4 mm.

3. A container according to claim 1, wherein the bottom of the deformable groove has a radius of curvature of about 0.5 mm.

4. A container according to claim 1, wherein the plane faces of the deformable groove form between them an angle that lies in the range about 60° to 80°.

5. A container according to claim 4, wherein the plane faces of the deformable groove form between them an angle of about 70°.

6. A container according to claim 1, wherein the rounded wall between the plane faces and the curvilinear faces possesses a radius of curvature that lies in the range about 0.8 mm to 1.2 mm.

7. A container according to claim 6, wherein the rounded wall between the plane faces and the curvilinear faces possesses a radius of curvature of about 1 mm.

8. A container according to claim 1, including a plurality of deformable grooves that are spaced apart axially from one another.

9. A container according to claim 8, wherein at least some of the deformable grooves are disposed one after another.

10. A container according to claim 8, wherein at least one non-deformable groove is interposed between at least some of the deformable grooves.

11. A container according to claim 10, wherein the deformable grooves alternate with non-deformable grooves.

12. A container according to claim 8, wherein a small number of the deformable grooves are grouped together in one portion of the body of the container, and wherein the remainder of the body does not have grooves.

13. A container, in particular a bottle, made of thermoplastic material such as PET, and including a body having a wall and provided with at least one peripheral closed-loop designed groove and that extends in a plane that is substantially perpendicular to the axis of the body, wherein the groove possesses a depth (p) that lies in the range about 3 mm to 6 mm, and wherein, in a transverse section, the groove comprises:

a bottom that is substantially rounded without a flat bottom portion, having a relatively small radius of curvature that lies in the range 0.2 mm to 1.5 mm;

two faces that are substantially plane and that flare apart from each other on either side of said bottom, forming between them an angle that lies in the range about 50° to 90°; and two faces that are curvilinear, and connected at one end to a respective plane face, and which extend away from their respective plane face in a direction different from the direction of the plane face, such that an angle formed at the connection between the plane face and the curvilinear face is substantially less than 180°, and wherein the plane face and curvilinear face are connected thereto by respective rounded walls of relatively small radius of curvature that does not exceed 1.5 mm, and wherein the other end of each curvilinear face is connected substantially tangentially to the wall of the body;

whereby the groove is an axially deformable groove that possesses a capacity to pinch axially in the presence of an axial force applied to the container.

14. A container according to claim 13, wherein the cross-sectional shape of the groove is V-shaped.

15. A container according to claim 1, wherein the cross-sectional shape of the groove is V-shaped.

* * * * *